United States Patent [19]

Sluyterman

[11] Patent Number: 5,036,250

[45] Date of Patent: Jul. 30, 1991

[54] PICTURE DISPLAY DEVICE WITH CORE MEANS COMPRISING COMPENSATION COILS

[75] Inventor: Albertus A. S. Sluyterman, Eindoven, Netherlands

[73] Assignee: U.S. Philips Corporation, New York, N.Y.

[21] Appl. No.: 359,319

[22] Filed: May 31, 1989

[30] Foreign Application Priority Data

Jun. 14, 1988 [NL] Netherlands ..... 8801512
Nov. 15, 1988 [NL] Netherlands ..... 8802802

[51] Int. Cl.[5] ..... H01J 29/00
[52] U.S. Cl. ..... 315/8
[58] Field of Search ..... 315/8, 85

[56] References Cited

U.S. PATENT DOCUMENTS 4,853,588 8/1989 Ohtsu et al. ..... 315/8 X

OTHER PUBLICATIONS

"Cancellation of Leaked Magnetic Flux", IBM Technical Disclosure, vol. 30, No. 12, May 1988.

*Primary Examiner*—Robert J. Pascal

[57] ABSTRACT

Picture display device comprising a display tube, a deflection unit and a compensation coil system for generating a magnetic compensation field which is oppositely directed to the line frequency radiation field of the deflection unit in a space in front of the display screen. The compensation coil system comprises two coils each being wound on a rod-shaped core portion. The core portions are arranged in a V-formation in the y-z plane, symmetrically relative to the x-z plane. Alternatively, the compensation coil system may comprise two pairs of coils arranged in this way and located in planes parallel to the x-y plane and equidistantly therefrom.

7 Claims, 3 Drawing Sheets

PICTURE DISPLAY DEVICE WITH CORE MEANS COMPRISING COMPENSATION COILS

BACKGROUND OF THE INVENTION

The invention relates to a picture display device having a display tube whose rear portion consists of a cylindrical neck accommodating a device for generating electron beams and whose front portion is funnel-shaped, the widest portion being present on the front side and comprising a phosphor display screen, said display device also comprising an electro-magnetic deflection unit mounted around a part of the display tube for deflecting electron beams across the display screen, said unit comprising a line deflection coil having two line deflection coil halves arranged one on each side of a plane of symmetry and a field deflection coil, and a compensation coil system for generating a magnetic compensation field which is oppositely directed to the line frequency radiation field in a space in front of the display screen.

A picture display device comprising a compensation coil system for compensating stray fields from the line deflection coil is known from EP-A 220,777.

Recently more stringent standards have been introduced for certain types of picture display devices, notably for monitors, with respect to the magnetic interference field which they may produce. An important source of magnetic interference fields is the line deflection coil because it is operated at radio frequency currents (frequencies in the range of 10 to 100 kHz) as contrasted to the field deflection coil. It is impossible to design a satisfactorily operating deflection coil which does not produce a stray field. If the stray field were to be eliminated by means of a protective shield, such a shield would only be effective if the combination of the display tube and the deflection unit were also shielded on the display screen side. The external magnetic field of a deflection unit is not very strong; in fact, at a distance of 50 cm from the front side of a deflection unit for a 110° monochrome display tube the field strength has already decreased to approximately 1% of the strength of the earth's magnetic field, but it is the variation of the field with respect to time which is important. Field variations may cause interferences in other electronic apparatus, and research is being done to establish whether human health is affected by these fields. Presently the time derivative of the field of the deflection unit increases with the increase of the line frequencies and hence with increasingly shorter fly-back periods.

For compensating the line deflection stray field the use of a compensation coil system which, when energized, generates a compensating magnetic dipole field is described in EP-A 220,777. This dipole field can be obtained by energizing one coil whose turns are mainly located in one flat plane (a "current loop"), wherein the coil has the correct number of turns, the correct surface area and the correct orientation. Energization may be effected, for example, by arranging the compensation coil in series with or parallel to the line deflection coil. The compensation field may be obtained alternatively by energizing two "current loops" which are positioned on either side of the line deflection coil, and have the correct number of turns, the correct surface area and the correct orientation. Also energization may be effected, for example, by arranging the compensation coils constituted by the current loops in series with or parallel to the line deflection coil.

The compensation coils are preferably large so as to reduce their energy content.

However, a problem is that many types of display devices (particularly monitors) lack the space to accommodate large coil systems in their correct position. Consequently, relatively small (too small) compensation coils must be used so that the radiation compensation consumes much (line deflection) energy. Moreover, the sensitivity of the line deflection coil is detrimentally influenced if the compensation coil system is arranged in series with the line deflection coil. The induction then increases.

SUMMARY OF THE INVENTION

It is the object of the invention to provide compensation of the radiation field of the line deflection coil with less energy and less sensitivity than is realized by the known measures.

The invention has a compensation coil system on the screen-sided end of the deflection unit and which includes at least one pair of core means, each core means comprising a rod-shaped magnetic core portion provided with a coil and extending in a plane whose normal is transverse to the longitudinal axis of the display tube, said core means being positioned symmetrically about a plane of symmetry and symmetrically with respect to a plane which including the longitudinal tube axis and which is transverse to the plane of symmetry, the longitudinal axes of co-planar core means intersecting the plane of symmetry at substantially the same, retrograde point at an acute angle of $90° - \phi$, and the centers of the core means of each pair being situated between the center of the deflection unit and the display screen.

The simplicity of this solution for radiation compensation, which is based on the use of rod-shaped core means of a magnetizable material provided with toroidal compensation coils, is superior to all known solutions based on the use of coreless, i.e. air-cored coils. A coil surrounding a core of a magnetizable material occupies little space and its loss of sensitivity is small.

Within the scope of the invention the compensation coil system may comprise a first pair of core means extending in a first plane whose normal is transverse to the tube axis, and a second pair of core means extending in a second plane whose normal is transverse to the tube axis, said first and second planes being located equidistantly from the tube axis. A configuration which was tested was found to compensate the line deflection stray field effectively, while there was less loss of deflection sensitivity (for example, 5 times less) times less) than in the known compensation coil systems.

An embodiment which provides even more advantages is characterized in that the compensation coil system comprises one pair of core means extending in a plane which comprises the tube axis and which is transverse to the plane of symmetry of the line deflection coils. For the two core means arranged in this way there is considerably more space available in the forward direction than for the four core means described above. This is important because the effectiveness of the compensation may be greater as the magnetic core portions extend further to the front from the front side of the deflection unit.

The core portions of the two core means are preferably arranged in a magnetic flux-exchanging relationship with a magnetic material yoke ring surrounding the line deflection coil. The combination of yoke ring and two core portions then effectively act as one core portion of very great length. Due to the fact that the diameter of the line deflection coil and the yoke ring surrounding it increases towards the display screen, the radiation center of the deflection unit does not coincide with its mechanical center, but is located at a short distance, several centimeters, in front of the deflection unit in the display tube. The prior solutions do not allow the positioning of the compensation coil or coils in such a way that the radiation center of the compensation coil system coincides with the radiation center of the deflection unit. The generation of the dipole compensation field is consequently accompanied by the generation of a higher order magnetic field (four-pole field, six-pole field, dependent on the configuration chosen). Generally it is necessary to compensate for this higher order field to comply with the interference standards. An additional compensation coil system is then required. This problem does not present itself in the device according to the invention because it is possible to position the core portions of magnetizable material with the associated compensation coils in such a way that they largely compensate for the fact that the radiation center of the compensation coil system does not coincide with the radiation center of the deflection unit. To this end the angle $\phi$ can be adjusted as a function of the distance z between the plane through the centers of the core portions and the radiation centre of the deflection unit. The angle $\phi$ is defined as the angle between the longitudinal axes of the core portion and a plane intersecting the plane of symmetry at the retrograde point and transverse to the plane of symmetry. That is, $\phi$ defines the angle between the longitudinal axis of a core portion and a plane passing through the retrograde point having a normal parallel to the longitudinal tube axis.

For compensating an unwanted four-pole component, the angle $\phi$ is adjusted in such a way that tg $\phi = z/y$ in which y is the distance between the centers of the core portions and the plane of symmetry and z is the distance between the plane through the centres of the core portions and the radiation centre of the deflection unit.

A practical method of connecting the compensation coil system includes employing coils that have the same winding direction and are adapted to be connected to a line frequency radiation source such that the fields which they generate have the same direction.

BRIEF DESCRIPTION OF THE DRAWINGS

Some embodiments of the invention will be described in greater detail with reference to the accompanying drawings in which.

DETAILED DESCRIPTION OF PREFERRED EMBODIMENTS

Figure 1:
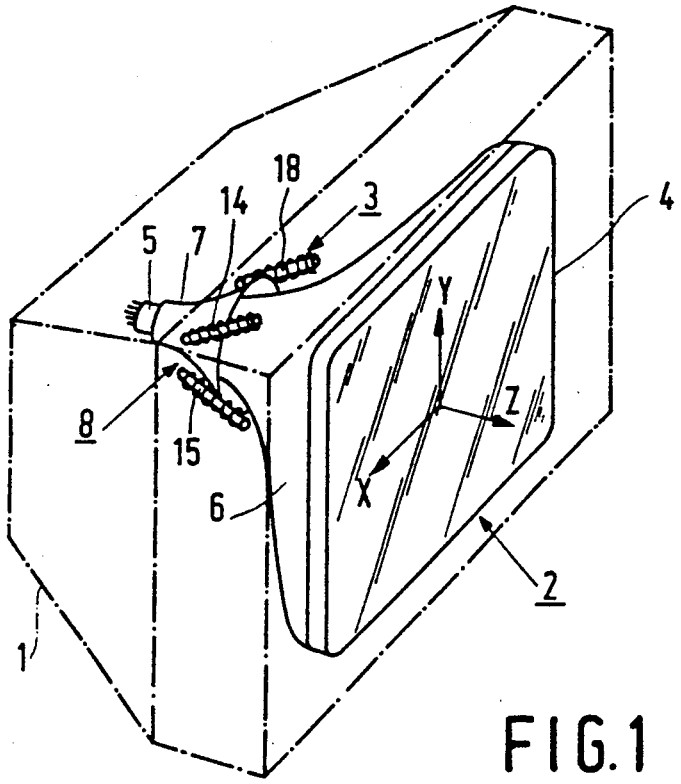
FIG. 1 is a perspective elevational view of a picture display device including a display tube having an electromagnetic deflection unit including a yoke ring and a compensation coil system according to the invention.

As shown in FIG. 1 an electro-magnetic deflection unit 8 and a display tube 2, are placed in a cabinet 1 and includes a compensation coil system 3 according to the invention.

The display tube 2 has a cylindrical neck 5 and a funnel-shaped portion cone 6 the widest portion of which is present on the front side of the tube and which comprises a display screen 4.

The display screen includes phosphors which upon impingement by electrons, luminesce in a predetermined color. The rear portion of the neck 5 accommodates an electron gun system (not shown). At the area of the transition between the neck 5 and the funnel-shaped portion 6 the electro-magnetic deflection unit 8 is arranged on the tube. The unit 8 includes a line deflection coil having halves *9a* and *9b* within a yoke ring 7 for deflecting the electron beams in the horizontal direction x. The line deflection coil generally comprises two saddle-shaped coil halves *9a*, *9b* which are arranged one on each side of a plane of symmetry (the X-Z plane). In the operating condition a sawtooth current having a frequency of between 10 and 100 kHz, for example, a frequency of approximately 64 kHz, is passed through these coil halves. Generally the line deflection coil is surrounded by an annular core element *7a* of soft-magnetic material yoke ring.

When the radiation field of the line deflection coil having the yoke ring 7 is initially equally large but opposed to that of a coil without a yoke ring, the line deflection coil can be assumed for large distances to be a current loop having a given magnetic moment.

The field $B_o$ in the radiation center of a line deflection coil without a yoke ring can be calculated to be approximately 30 Gauss. The field of a practical deflection coil having a yoke ring has approximately twice this value.

Figure 2:
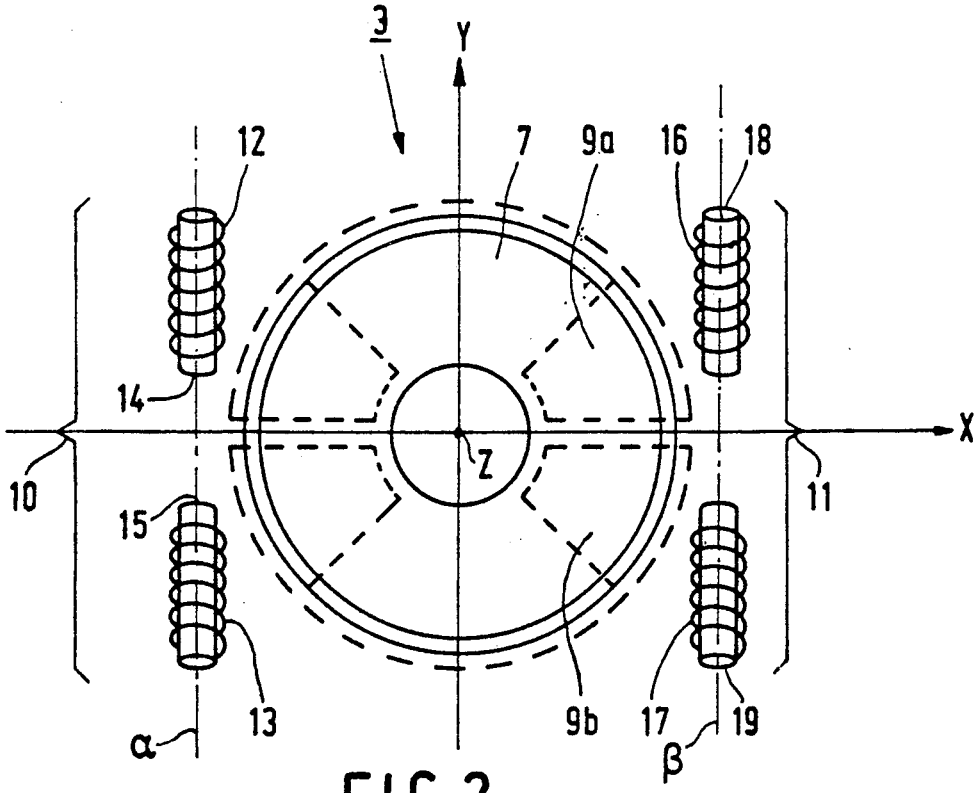
FIG. 2 is a diagrammatic front elevation of a yoke ring and a compensation coil system.
Figure 3:
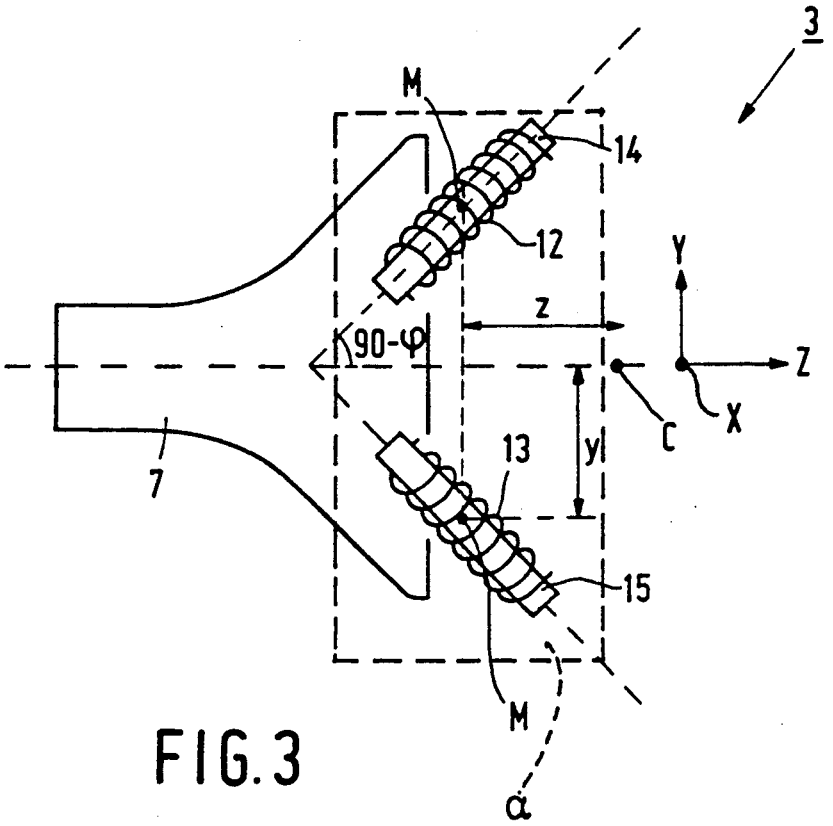
FIG. 3 is a diagrammatic side view of a yoke ring and a compensation coil system.

As shown in FIGS. 2 and 3, the compensation coil system 3 having core means with coils wound on core portions is used for compensating the radiation field.

Refferring to FIG. 2, the yoke ring 7 of the display tube 2 of FIG. 1 is, combined with the compensation coil system 3 according to the invention, the two line deflection coil halves *9a* and *9b* (denoted by a broken line) are positioned symmetrically relative to the plane of the X-Z plane and are substantially arranged within the yoke ring 7. The compensation coil system 3 includes a first pair of core means 10 having two core portions 14 and 15 provided with compensation coils 12 and 13, and a second pair of core means 11 having two core portions 18 and 19 provided with compensation coils 16 and 17. Each core portion 14, 15, 18 and 19 having a center M. The stray field radiation field, which is generated by the line deflection coil *9a*, *9b* outside the display tube 2, particularly on the front side of the display screen, can be compensated for by energizing the compensation coil system in the correct manner. The core means 10 lie in a plane $\alpha$ whose normal is transverse to the tube axis z. The pair of core means 11 extends in a plane $\beta$ whose normal is transverse to the tube axis Z. The planes $\alpha$ and $\beta$ are located equidistantly from the tube axis z.

As is shown in FIG. 3, the core portions 14 and 15 (and 18, 19) are tilted in a given way with respect to a line passing through their centers M and a line being parallel to the x-z plane. The extent of tilt is related to the distance of this plane from the radiation center of the deflection unit. This will be explained in greater detail with reference to FIG. 4.

Figure 4:
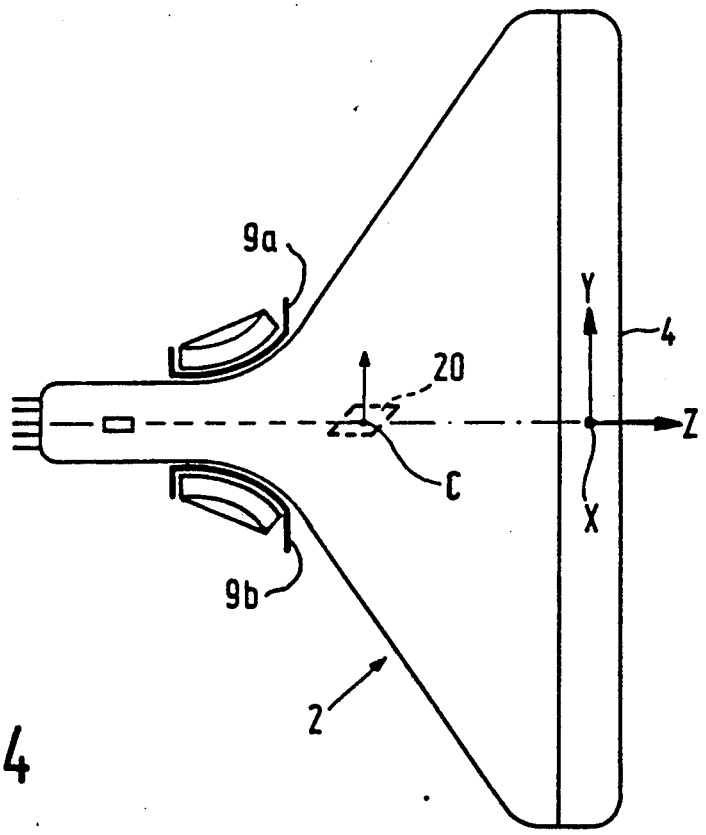
FIG. 4 is a diagrammatic longitudinal section of a display tube and a deflection unit.

The interfering field of the line deflection coil 9*a*, 9*b* may be roughly considered to be a dipole in the tube 2 that is current loop 20. Referring to FIGS. 3 and 4, since the diameter of the line deflection coil 9*a*, 9*b* increases towards the display screen 4, the center C of the radiation field of the line deflection coil is located in front of the line deflection coil. That is, between the display screen 4 and the line deflection coil 9*a*, 9*b*.

Thus, a problem is how the radiation center of a possible compensation coil arrangement must be made to coincide with the (imaginary) radiation center of the line deflection coil. If these centers do not coincide, the dipole radiation field can be compensated for, but then, for example, a four-pole field component is introduced.

The present invention recognizes this problem, which has led to the design of a completely novel compensation coil arrangement. As shown in FIGS. 2 or 3 embodiment uses the four compensation coils 12, 13, 16, 17 which are wound on the rod-shaped core portions 14, 15, 18, 19 of a magnetizable material.

The (axes of the ) core portions 14, 15, 18, 19 extend at an angle of $90°-\phi$ to the X-Z plane. To ensure that a possibly introduced 4-pole field component is compensated for as much as possible, $\phi$ can be adjusted in such a way that the relation tangent $\phi=z/y$ is satisfied, with z being the distance between a plane through the centers of the core portions 14, 15, 18, 19 and the radiation center C, and y being the distance between the centers M of the core portions 14, 15, 18, 19 and the X-Z plane. In a given application the rod-shaped core portions 14, 15, 18, 19 had a length of 60 mm and a diameter of 5 mm, and they were made of 4C6 ferrite. Rod lengths of, for example, between 5 and 10 cm were found to be suitable in practice. The core portions 14, 15, 18, 19 are surrounded by coils 12, 13, 16, 17 having a limited number of turns (in connection with the induction) and preferably extending through the greater part of the length of the core portions.

Permanent magnets may be arranged at opposite ends of the rod-shaped core portions for the purpose of landing error correction.

Figure 5:
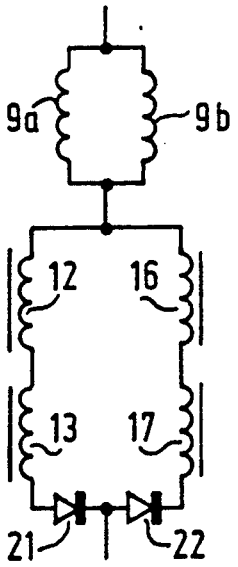
FIG. 5 is an electric circuit diagram for a method of connecting a compensation coil system.

Another possibility of reducing the influence of landing errors when using compensation coils wound on rod-shaped core portions is the addition of a configuration with two diodes. In principle, the compensation coil pairs are then arranged in parallel, as is shown diagrammatically in FIG. 5, in which two parallel-arranged line deflection coils 9*a*, 9*b* are connected in series with two parallel-arranged compensation coil pairs 12, 13 and 16, 17. Diodes 21, 22 ensure that the line deflection current is mainly passed through the "left-hand" compensation coil branch when the electron beams are deflected to the "right" on the display screen, and conversely.

Figure 6:
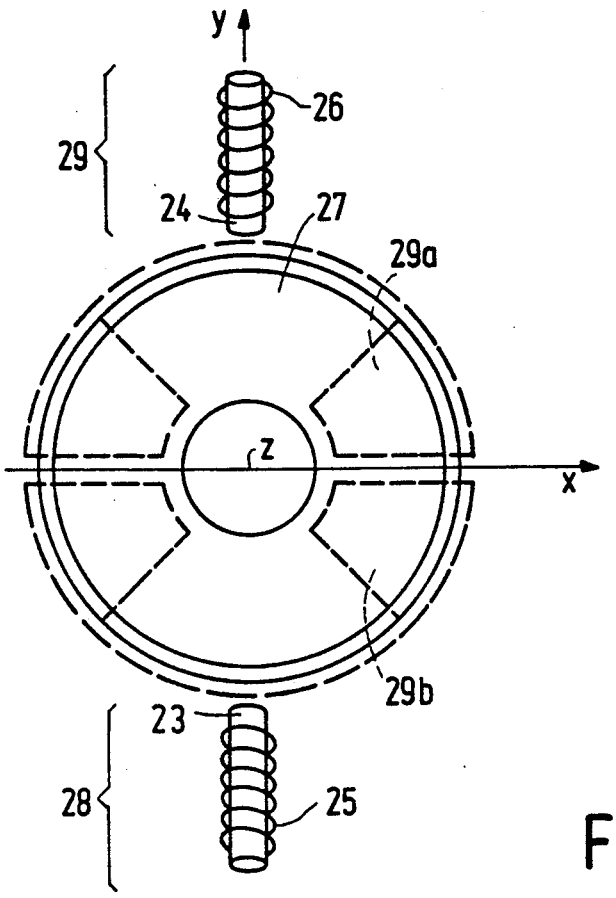
FIG. 6 is a diagrammatic front elevation of a yoke ring with an alternative compensation coil system.
Figure 7:
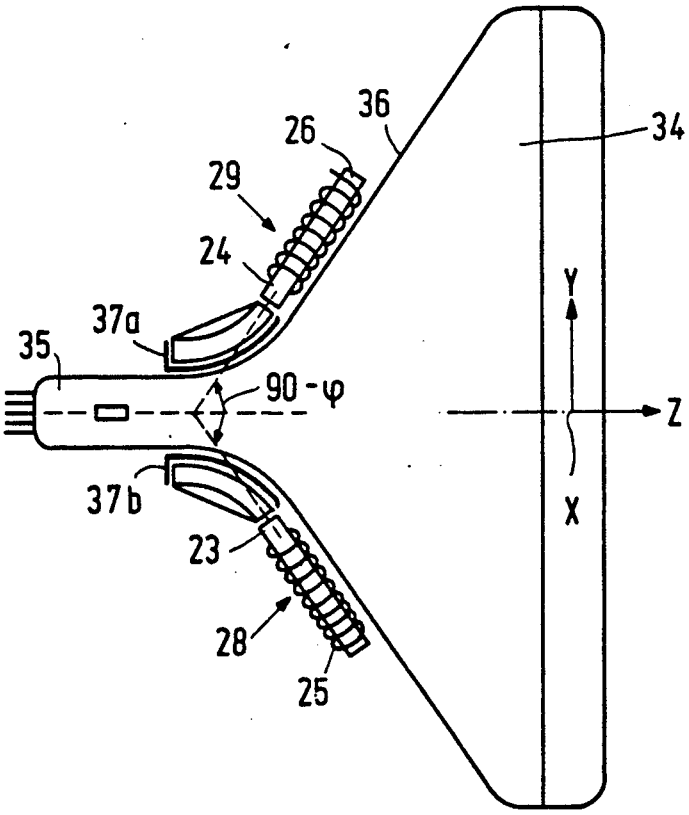
FIG. 7 is a longitudinal section of the yoke ring with an alternative compensation coil as shown in FIG. 6.

FIG. 6 is a front elevation of a yoke ring 27 with a compensation coil arrangement which is suitable for use in an alternative embodiment of a device according to the invention. Two line deflection coil halves 29*a* and 29*b* (denoted by a broken line) positioned symmetrically relative to the plane of symmetry X-Z are arranged for the greater part within the yoke ring 27. In this case the compensation coil system comprises one pair of core means 28, 29 consisting of a magnetic core portion 23 with a compensation coil 25 and a magnetic core portion 24 with a compensation coil 26. The core means 28, 29 extend in the y-z plane and are arranged symmetrically relative to the x-z plane. As can be seen in FIG. 7, which shows a display tube 34 having a neck 36 and a funnel-shaped portion 36, the core means 28, 29 are positioned in the y-z plane in such a way that they intersect the the x-z plane at substantially the same, retrograde point P at an angle of $90°\phi$.

An advantage of the compensation coil arrangement shown in FIGS. 6 and 7 is that the coils 25 and 26 can be formed in a simple manner by using lead-outs of the line deflection coil halves 37*a*, 37*b* and by winding them around the core portions 23, 24 (obliquely pointing forwards).

Another advantage is that the core portions 23, 24 can be positioned relative to the yoke ring 27 in such a way that they are in a magnetic flux-coupling relationship with it. As it were, one continuous core portion of great length is then formed, and the compensation requires less deflection energy than in other cases.

Yet another advantage is that an extra circuit configuration with diodes (FIG. 5) need not be used.

I claim:

1. A picture display device having a display tube whose rear portion includes a cylindrical neck accommodating a device for generating electron beams and whose front portion is funnel-shaped, the widest portion being present on the front side and including a phosphor display screen, the display tube having a longitudinal axis extending concentrically through the neck and the front portion, an electro-magnetic deflection unit mounted around a part of the display tube for deflecting electron beams across the display screen, the electromagnetic deflection unit including a line deflection coil having two line deflection coil halves wherein one line deflection coil half is disposed on on each side of a plane of symmetry, and a field deflection coil, comprising:

compensation coil means for generating a magnetic compensation field which is oppositely directed to a line frequency radiation field in front of the display screen wherein the compensation coil means is proximate to a screen end of the deflection unit and includes one pair of core means disposed in a core plane whose normal is transverse to the longitudinal axis of the display tube, each core means having a longitudinal axis and comprising a rod-shaped magnetic core portion and a coil the core means being positioned symmetrically with respect to the plane of symmetry and symmetrically with respect to a plane which includes the longitudinal tube axis and which is transverse to the plane of symmetry, the longitudinal axes of the core means intersecting the plane of symmetry at substantially the same, retrograde point at an acute angle in the plane of symmetry, and the centers of the core means of each pair being situated between the center of the deflection unit and the display screen.

2. A picture display device as claimed in claim 1, wherein the compensation coil means includes one pair of core means extending in a plane which includes the longitudinal tube axis and is transverse to the plane of symmetry of the line deflection coils.

3. A picture display device as claimed in claim 2, further comprising a magnetic material yoke ring surrounding the line deflection coil, wherein the core portions of the core means are arranged in a magnetic flux exchanging relationship with the yoke.

4. A picture display device as claimed in claim 1, wherein the compensation coil means comprises a first pair of core means extending in a first plane whose normal is transverse to the longitudinal tube axis, and a second pair of core means extending in a second plane whose normal is transverse to the longitudinal tube axis, said first and second planes being located equidistantly from the longitudinal tube axis.

5. A picture display device as claimed in claim 1, wherein $\tan \phi = z/y$, with z being the distance between the plane through the centres of the core portions and the radiation centre of the deflection unit, y being the distance between the centres of the core portions and the plane of symmetry and $\phi$ is the angle between the longitudinal axis of a core means and a plane passing through the retrograde point having a normal parallel to the longitudinal tube axis.

6. A picture display device as claimed in claim 1, further comprising a line frequency radiation source, wherein the compensation coils have the same winding direction and are adapted to be connected to the line frequency radiation source in such a way that the fields which the compensation coils generate have the same direction.

7. A picture display device as claimed in claim 4, further comprising diode means electrically connected to the coils arranged on the rod shaped core portions, such that the coil which is most remote from the deflected beams is energized.

* * * * *